United States Patent [19]

Bjarnason et al.

[11] Patent Number: 4,498,818

[45] Date of Patent: Feb. 12, 1985

[54] DEVICE FOR BATCH FEEDING OF A FLUIDIZABLE PARTICULATE MATERIAL

[75] Inventors: Gudmundur Bjarnason, Reykjavik; Thorsteinn Eggertsson, Gardabae, both of Iceland

[73] Assignee: Swiss Aluminium Ltd., Chippis, Switzerland

[21] Appl. No.: 622,241

[22] Filed: Jun. 19, 1984

Related U.S. Application Data

[63] Continuation of Ser. No. 359,266, Mar. 18, 1982, abandoned.

[30] Foreign Application Priority Data

Mar. 30, 1981 [CH] Switzerland ..... 2130/81

[51] Int. Cl.[3] ..... B65G 53/50

[52] U.S. Cl. ..... 406/137; 406/127

[58] Field of Search ..... 406/106, 108, 122, 127, 406/133, 136, 137, 138, 93–95; 222/195, 200, 547, 564

[56] References Cited

FOREIGN PATENT DOCUMENTS

| | | | |
|---|---|---|---|
| 1952131 | 4/1971 | Fed. Rep. of Germany | 406/138 |
| 987622 | 8/1951 | France | 406/137 |

*Primary Examiner*—Jeffrey V. Nase

*Attorney, Agent, or Firm*—Bachman and LaPointe

[57] ABSTRACT

A silo for storing alumina having a conical outlet at the bottom thereof is fitted with an exchangeable feeding unit mounted over the conical outlet opening. The feeding unit is adapted to close off the outlet opening when in the non-operative position. The feeding unit can take various forms and includes at least one injection nozzle for fluidizing the particulate material.

6 Claims, 5 Drawing Figures

DEVICE FOR BATCH FEEDING OF A FLUIDIZABLE PARTICULATE MATERIAL

This is a continuation of application Ser. No. 359,266 filed Mar. 18, 1982, now abandoned.

BACKGROUND OF THE INVENTION

The invention relates to a device for batch feeding a fluidizable particulate material from a silo-having at the bottom thereof a closable, conical outlet into a reaction vessel and in particular, alumina from a day's storage silo to a break in the crust on an electrolyte cell used in manufacturing aluminum by the fused salt electrolytic process.

The production of aluminum by the fused salt electrolytic reduction of aluminum oxide involves the latter being dissolved in a fluoride melt comprised for the greater part, of cryolite. The cathodically precipitated aluminum collects under the fluoride melt on the carbon floor of the cell, the surface of the liquid aluminum itself forming the actual cathode. Dipping into the melt from above are anodes which, in conventional processes, are made of amorphous carbon. As a result of the electrolytic decomposition of the aluminum oxide, oxygen forms at these carbon anodes and combines with the carbon to form $CO_2$ and CO. The electrolytic process takes place at a temperature in the range of approx. 940°-970° C.

During the course of the electrolytic process the electrolyte becomes depleted in aluminum oxide. At a lower concentration of 1-2 wt% aluminum oxide in the electrolyte an anode effect occurs whereby the voltage increases for example from about 4-5 V to 30 V or more. At this time the crust of solid electrolyte material should be broken open and the concentration of aluminum oxide increased by adding alumina.

Under normal production conditions the cell is normally fed alumina at regular intervals even when no anode effect occurs. In addition, each time the anode effect occurs, the crust is broken open and the alumina concentration increased by addition of aluminum oxide. The foregoing constitutes servicing of the cell.

For many years now servicing the cell has included breaking open the crust between the anodes and the sidewall of the cell and adding alumina there. This practice has met with increasing criticism because of pollution of the air which occurs in the pot room and the surrounding area. In the case of hooded pots, maximum capture of the pot fumes can be achieved only if the servicing of the cell is automated. After breaking open the crust, the alumina is added either locally and continuously according to the point feeder principle or discontinuously over the whole of the longitudinal or transverse axis of the cell.

The known alumina storage bunkers or silos mounted on the electrolyte cells are in the form of funnels or containers with a funnel-shaped or conical outlet in the lower part. The storage content of the silo on the cell meets the cell requirements for one to two days, and can therefore be called day's storage silo.

The feeding of alumina from the silo to a break in the crust on the molten electrolyte takes place in known devices by opening a flap which is lowered for cell charging purposes, or by means of other systems employing feeding screws, pistons or the like.

These feeding devices have the disadvantage that mechanically moveable parts must be built into the reduction cell. Consequently they are exposed to the heat and dust of the cell atmosphere which makes maintenance necessary to a greater or lesser extent. In many versions there is the danger of mechanical damage, in particular during the changing of the anodes.

It is therefore the object of the inventors to develop a device for continuous controlled feeding of a fluidizable particulate material, with no mechanically moveable elements and in the form of a compact, robust unit which can be built into a silo, and such that due to its simple construction the said device is economic to manufacture and, to a large extent, maintenance free.

SUMMARY OF THE INVENTION

The foregoing object is achieved by way of the present invention wherein an exchangeable feeding unit is positioned immediately over the silo outlet opening which is closed in the non-operative phase, the said feeding unit having at least:

(a) one siphon which leads to the outlet opening via a feed shaft; and (b) one injection nozzle (16) per siphon with a nozzle outlet situated above the lower edge of the siphon dividing wall.

According to a first exemplified embodiment of the invention the outer walls of the siphon are formed by a base plate resting on the conical lower part of the silo, and the feed shaft. These single piece or welded outer walls run around the silo outlet in the form of a trough.

The whole of the outer surface of the base plate of the feeding unit lies against the conical lower part of the silo and is welded, rivetted or preferably bolted to it. A bolted base plate offers the advantage that the means for securing the plate in place can be easily loosened whenever required and the feeding unit removed through the silo.

The feed shaft and thus the outlet opening in the silo is closed off with a cover sheet. The sidewalls of the cover sheet project into the trough formed by the base plate and feed shaft and form the siphon dividing wall. Due to the weight of material in the silo, this fluidizable material in the lower part of the siphon becomes compacted. In order for this material to pass into the feed shaft, the said material must flow around the siphon dividing wall and upwards. The height of the feed shaft is chosen such that the particulate material, under the static load of an adequately full silo, cannot flow up to the upper edge of the shaft.

The geometric form of the outlet opening and the feed shaft is chosen to suit the crust breaking device. For point feeding of alumina the opening is usefully round, square or rectangular. The inner wall of the feed shaft corresponds, preferably exactly, to the size of the outlet opening.

The part of the top sheet covering over the inlet to the feed shaft is, for manufacturing and economic reasons, preferably flat or slightly concave, although it can usefully be of any geometrical shape such as conical, pyramidal or saddle-shaped.

The inner diameter of the injection nozzles can for example, be 4-10 mm. The outlet can be the same diameter or reduced to a diameter of down to 1 mm. The number of nozzles is usefully 3 to 6 for round or square shaped silo outlets, which are preferred in particular for point feeding of alumina. In the case of elongated outlets for control or transverse feeding 3 nozzles are provided on the long sides, but none on the end faces.

In the non-operative phase, that is when not feeding, but when there is an adequate amount of alumina in the silo, the alumina rises in the space between the top sheet and the shaft and this by a specific amount determined by the flow properties of the material and the geometry of the feeding unit. The flow properties can be described for example in terms of the angle of friction (the angle to the horizontal formed by the top surface of the free-standing heap of particulate material). The feeding system, however, does not react sensitively if particulate material of different flow characteristics is employed. The distance of the upper edge of the feed shaft from the lower edge of the top sheet is chosen such that the variation in the height due to the different flow properties of the particulate material is less than this distance.

In the operative phase compressed air is injected into the compacted material via the nozzles in the siphon. The pressure employed for this, also in the following examples with the same nozzles, is preferably 1–10 bar, in particular 3–6 bar. The particulate material fluidized by the compressed air can then, acting under pressure of the silo charge, flow over the upper edge of the feed shaft and fall through it. In the case of a cell for fused salt electrolytic production of aluminum, the alumina falls into the region of the break in the curst.

If the supply of compressed air is interrupted, the fluidized particulate material becomes compacted again. The flow of material cannot be maintained by the pressure of the material in the silo.

When using a single stage feed unit with one siphon, the size of charge fed fluctuates by at most around 5%.

The amount fed with each charge can be kept much more constant if two single stage feeding units are arranged in line. In the operative phase, with the upper injection nozzles functioning, the particulate material first flows out of the silo into a charge space immediately below the upper siphon. With respect to the lower, second feeding unit, this charge space represents the silo for the particulate material. If the upper nozzles are put out of action and the lower nozzles actuated, then the material in the charge space can flow out through the outlet opening.

Of fundamental importance may be that the removal of air can take place during filling of the charge space and the supply of air to the space during the emptying phase.

By employing two feeding units in series, the fluctuations in the amounts of material fed in each charge can be reduced to about 1%, assuming that the particulate material is homogeneous in quality.

A further improvement in the device according to the invention, in particular with respect to its simplification, is provided by having a charge space which is open at the top at all times and connects up with a siphon. At least one injection nozzle connects to the charge space, preferably a little below the inlet to that space.

In the non-operative phase the charge space is completely full of particulate material. In the operative phase air is injected through the nozzles for a specific interval of time and at a specific pressure. The particulate material thus flows through the siphon into the feed shaft. Although material flows from the silo into the charge space during the whole of the operative phase, the fluctuation in the charge delivered lies surprisingly at a value of less than 1%. In practical operation, it is therefore not necessary to fit at the entry port to the charge space a closure system such as is normally provided and which has to be actuated during the operative phase.

With all versions of the exchangeable feeding unit care must be taken that the angle of friction of the poorest fluidizable material is smaller than the inclination of the charge space wall of the conical, lower part of the silo. Otherwise, the required feeding accuracy cannot be attained. The inclination of the walls concerned is therefore at least 45°.

The alumina flowing into the feed shaft is fed to the break in the crust under free fall conditions. This flow of material can be directed accurately if a run-out pipe is provided below the feed shaft. This means, however, that a greater tendency for mechanical damage to occur must be accepted.

All devices according to the invention are characterized by the following advantages:

(a) No mechanical or otherwise moveable parts, and therefore insensitive to wear in dust-loden surroundings.
(b) To a large extent protected from heat and mechanical damage as they are built into the silo.
(c) Compact, robust and maintenance free unit which if needing repair can be readily removed from the top through the empty silo.
(d) Simple construction which is economic to manufacture.
(e) Readily automated.
(f) Independent of flow characteristics of the particulate material being fed.
(g) No problems of leakage when not in operation.

When employing the feeding unit for the supply of alumina to aluminum fused salt reduction cells there is a further advantage in that existing center-break cells can be converted to point feeding, usefully with two units, and this without incurring great expense. It is not necessary to make huge investments to replace the whole anode part of the cell. Only the following changes are required:

(a) Removal of alumina feed flap.
(b) Closing-off the silo opening above the outlet opening.
(c) Building-in the feeding units and fitting the compressed air pipe-lines.
(d) Conversion of the breaker beam to point breaking chisel operation.
(e) Adjustment of the pneumatic control.
(f) Connecting up to a data processor.

BRIEF DESCRIPTION OF THE DRAWINGS

The invention is explained in greater detail by way of the following drawings wherein.

DETAILED DESCRIPTION

Figure 1:
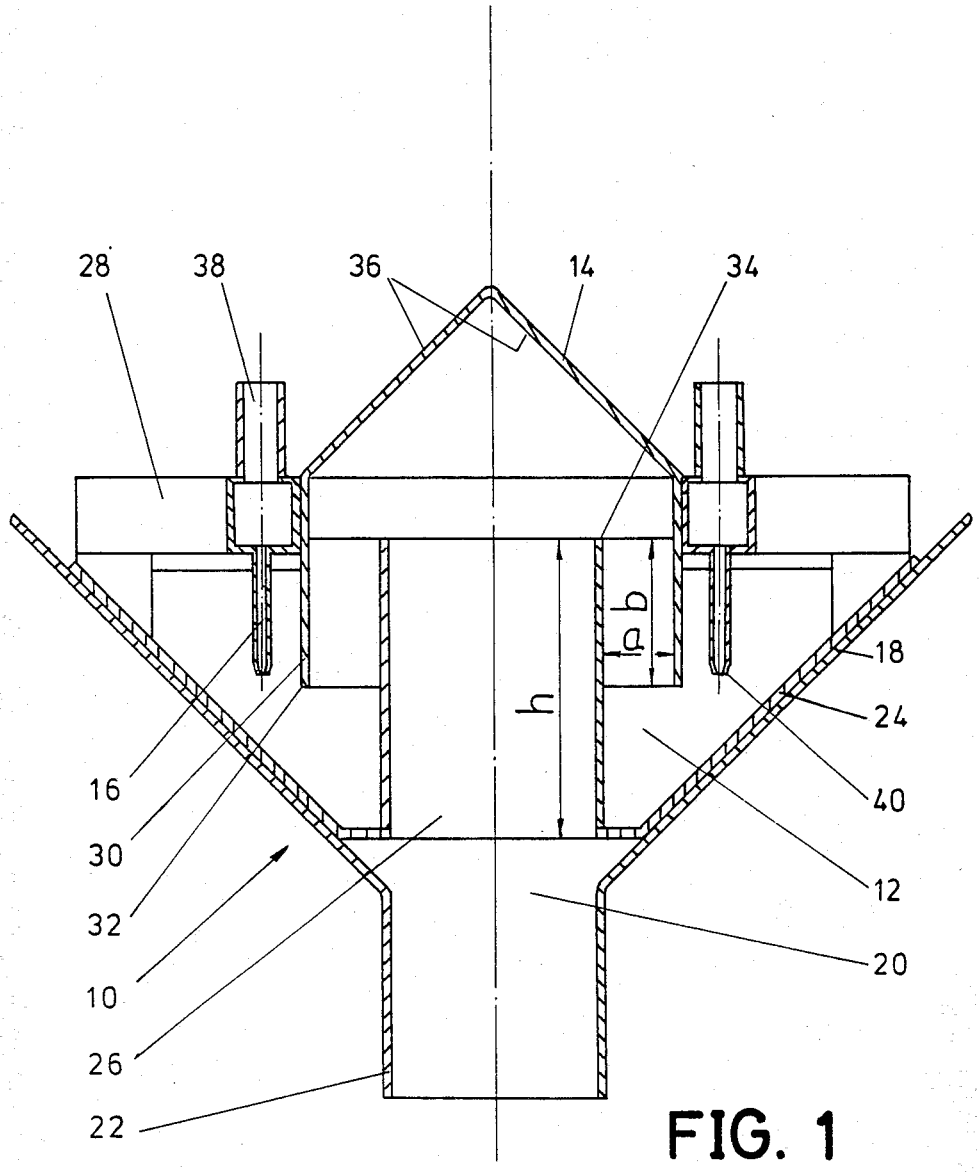
FIGS. 1 and 2 are sectional views of single stage feeding units.

FIG. 1 shows an exchangeable, pre-fabricated feeding unit 10, comprising essentially a siphon 12, a top sheet 14 and injection nozzles 16 i.e. a single stage unit. The lower conical part 18 of a silo ends in a circular shaped or rectangular outlet opening 20. In the present case the lowest part of the silo joins up to an outlet pipe 22.

The whole of the outer surface of the base plate 24 of feeding unit 10 lies against the inner surface of the conical part 18 of the silo. Together with the feeding shaft 26, the base plate 24 forms a trough which surrounds the outlet opening. The base plate and feeding shaft can be in one piece or can be a welded assembly.

A supporting device 28 for the top sheet 14 and injection nozzles 16 is in the form of a closed or open section and is itself supported by the base plate 24.

The vertical part of the top sheet 14 viz., the siphon dividing wall 30 is a distance a from the feeding shaft; the distance of the lower edge 32 of the top sheet 14 from the base plate 24 is of the same order of magnitude. The feeding shaft 26 is of height h, the vertical distance of its upper edge 34 from the lower edge 32 of the top sheet is a distance b. Normally a and b are approximately equal or b is slightly longer than a.

The part of the top sheet 14 over the opening of the feed shaft 26 form a roof 36 in the shape of a cone, pyramid or saddle; here, this part is simply called the roof.

Each of the injection nozzles 16 situated just outside the siphon dividing wall 30 has its own compressed air connection 38 or an interconnecting attachment is provided for several or all nozzles. The valves for controlling the supply of compressed air are preferably actuated electromagnetically via an electronic data processor program. Used in connection with a reduction cell for the fused salt electrolytic production of aluminum, the valves are positioned, as much as is possible, near the edge of the cell. The nozzle outlets 40 are just above the edge 32 of the siphon dividing wall 30.

Figure 2:
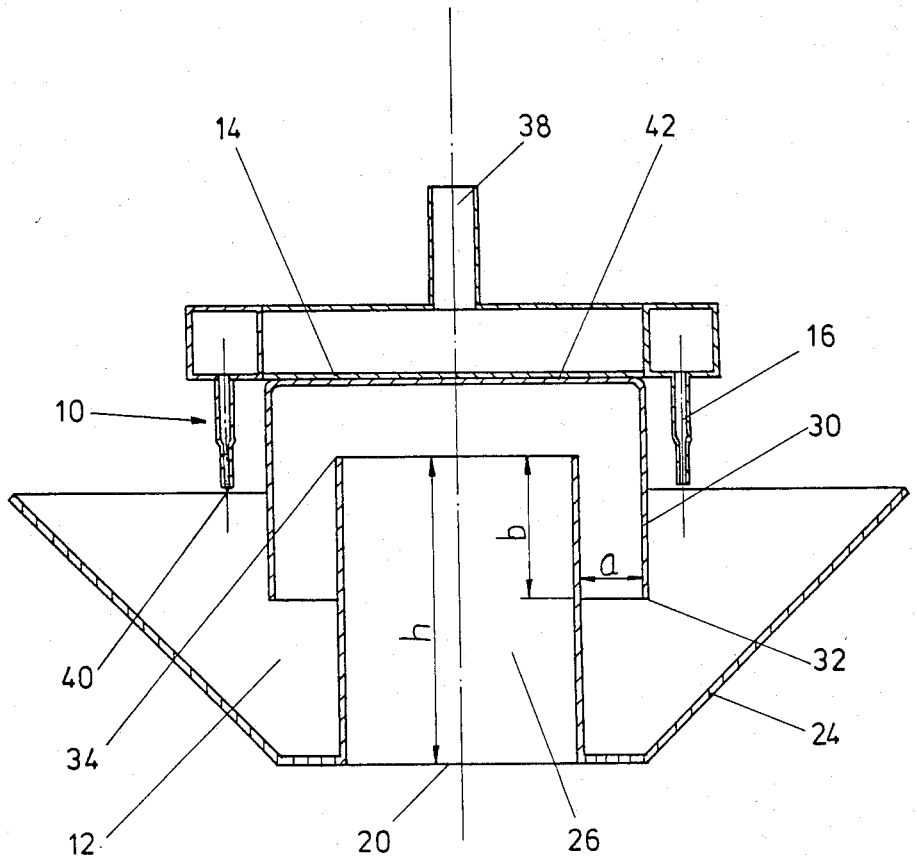

The likewise single stage feeding unit shown in FIG. 2 is in principle designed the same as that in FIG. 1 and features only two basic differences (the under part of the silo is not shown) that is (1) The roof 42 on the top sheet 14 is flat.

(2) The outlet opening 40 of the communicating, connected injection nozzles 16 are clearly further above the edge 32 of the siphon dividing wall 30.

Figure 3:
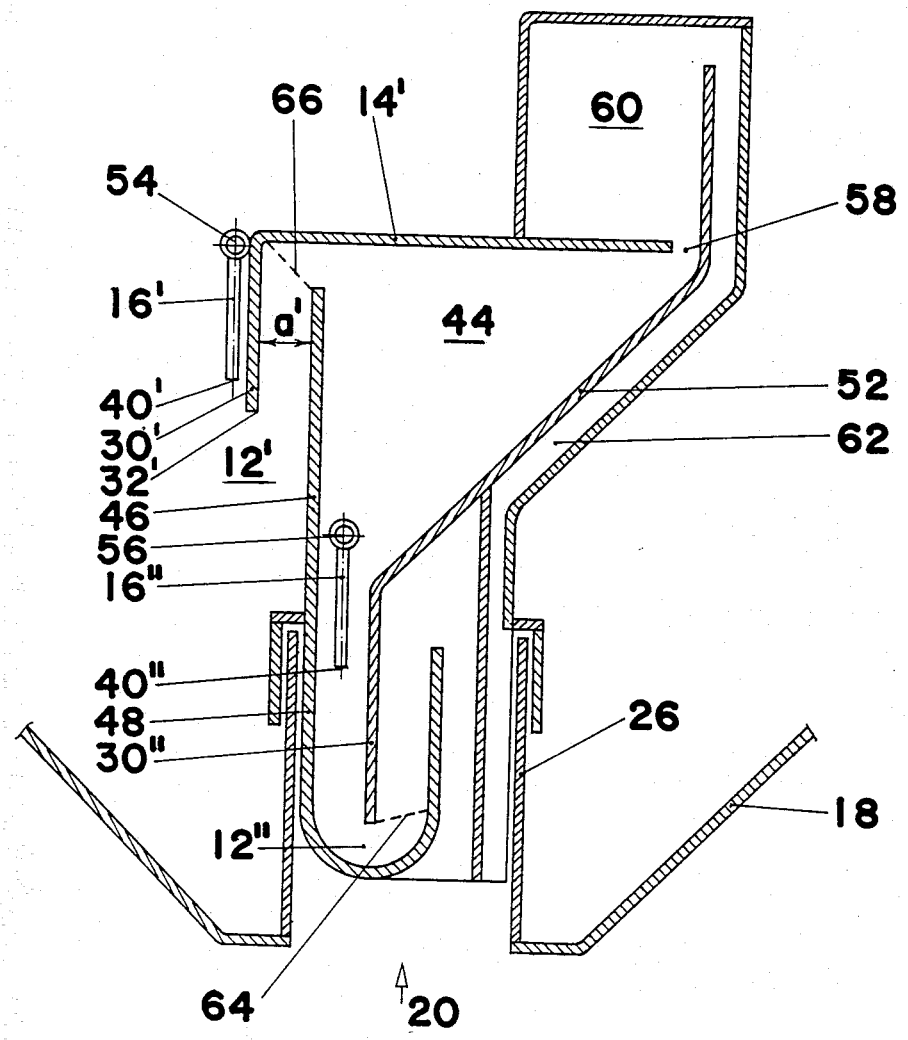
FIG. 3 Is a vertical section through two feeding units mounted in series one over the other.

FIG. 3 shows a two stage, exchangeable feeding unit which has been "pushed" on to the feeding shaft 26. This shaft 26 is then not a component part of the feeding unit, but is welded along the outlet opening to the bottom part 18 of the silo or is in one piece as part of the silo.

The sidewalls of the essentially prismatic charge space 44 which is rectangular in cross section are as follows:

(1) A horizontal top sheet 14' bent on the left hand side to form the upper siphon wall 30'.

(2) A vertical sidewall 46 which is situated a distance a' from the siphon sidewall 30' and towards the bottom becomes the U-shaped outer sidewall 48 of the lower siphon 12''

(3) A sidewall 52 which is inclined at an angle greater than the angle of friction of the material being fed with the facility.

Immediately outside the upper siphon dividing wall 30' are three upper injection nozzles 16' which are fed from a common gas pipe 54. The nozzle openings 40' are in the region of the edge 32' of the siphon dividing wall 30'.

The lowest horizontal region of the prism shaped space 44 connects up in one part to the lower siphon 12'' with U-shaped outer wall 48. The siphon 12'' is delimited inside by the lower siphon dividing wall 30'', formed by the vertical extension of the inclined sidewall 52. The lower three nozzles 16'' project, from a common gas supply pipe 56 in space 44, into the lower siphon 12''. The lower nozzles outlets 40'' can, depending on the flow characteristics of the material being fed, lie somewhat higher rather than lower.

As charge space 44 is filled, the waste gas escapes through an opening 58 into a dust precipitator 60 and from there via a channel 62 into the space under the cell hooding. From there the waste gas is drawn off with the cell fumes and cleaned. On emptying the space 44 on the other hand the ventilation takes place in the opposite direction.

In the non-operative phase the charge space 44 is completely full of particulate material. With respect to the dust precipitator 60, the opening 58 is the filling limit; in the lower siphon 12'' it is the cone 64 of material.

In the working phase the lower nozzles 16'' are switched on first, until space 44 and the lower siphon 12'' have been completely emptied. In the upper siphon 12' a cone 66 of material forms.

Immediately after turning off the lower nozzles 16'', the upper nozzles 16' are switched on until space 44 has been completely filled again.

Figure 4:
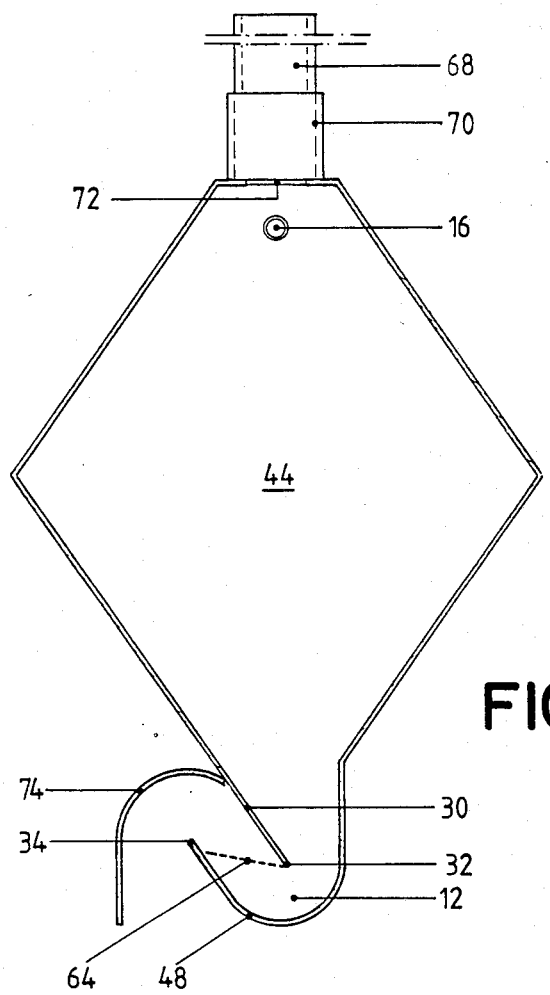
FIG. 4 Is a sectional view of a two stage feeding unit at the top open, at the bottom featuring a siphon.
Figure 5:
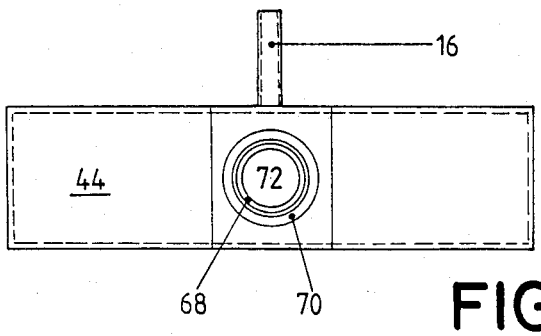
FIG. 5 Is a plan view of the feeding unit shown in FIG. 4.

The version according to FIGS. 4 and 5 represents a feeding unit of much simpler construction.

The charge space 44 is, in cross section in the form of an upright rhombus-shaped prism with short horizontal edges. Of course as versions of this specific embodiment one can have a shape of vertically arranged double pyramids or double cones, parallelpideds or cylinders with pyramidal or conical shaped ends etc. An essential requirement however in the above mentioned versions is the angle of friction. For this reason e.g. spherical charge spaces cannot be considered.

The charge space 44 is fed via pipe 68 projecting vertically into the silo filled with the particulate material. This is welded onto the charge space by means of a sleeve 70. The inlet opening 72 is dimensioned such that the charge space 44 is filled within ca. 30–90 sec. The inlet opening may be provided with a known closing system.

The whole of the lowest part of the charge space 44 is constructed as a siphon 12. The lower edge 32 of the siphon dividing wall 30 lies so low that the cone 64 of charge material does not reach the upper edge 34 of the U-shaped siphon outer wall 48. The feeding shaft is seen here as the curved sheet 74. The conical lower part of the silo, with the outlet opening, has been omitted here for sake of clarity. This is the same as in the previous example.

On one of the end walls of the charge space 44, a little below the intlet opening 72, is an injection nozzle 16 directed on the horizontal plane.

In the non-operative state the charge space 44 is completely full of particulate material, the lower limit being the cone 64 of material.

In the operative phase air is blown through the nozzle 16 and the fluidized particulate material flows through the siphon 12 within the space of only a few seconds. Particulate material flows during the whole of the emptying phase. The charge space 44 fills up again after the nozzle 16 has been switched off.

The feeding unit shown in FIGS. 4 and 5 is characterized not only by way of a simple construction—which makes it robust and economical—but also by a surprisingly high degree of accuracy in the amounts delivered with each charge. Various series of measurements of charges of 2500 g aluminum oxide have shown a deviation of less than 10 g. The accuracy of the feeding unit is therefore such that when delivering charges of aluminum oxide the fluctuation is much less than 1%.

The present invention is illustrated here principally in connection with the feeding of aluminum oxide to a fused salt electrolytic cell for producing aluminum. It is however not limited to these special exemplified embodiments but can in general be employed for controlled feeding of fluidizable particulate materials such as, for example, cryolite and cement, or rice, grain and sugar.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. In a silo having a selectively closeable outlet, an exchangeable feeding unit positioned over said outlet for batch feeding a fluidizable particulate material from the silo to a reaction vessel, said exchangeable feeding unit comprising wall means for defining a siphon chamber, a feeding shaft for communicating said siphon chamber with said silo outlet, a dividing wall positioned in said siphon chamber, said dividing wall having a free lower edge spaced from said wall means defining said siphon chamber and a nozzle having an outlet opening positioned in said siphon chamber such that the nozzle opening is above said lower edge of said dividing wall wherein said siphon chamber comprises an upper siphon chamber provided with nozzles, a charge space and a lower siphon chamber provided with nozzles wherein the nozzles in said upper siphon chamber and said lower siphon chamber can be actuated sequentially.

2. A feeding unit according to claim 1 including a source of air for jetting said charge space.

3. A feeding unit according to claim 2 further including an outlet from said charge space, said outlet communicating with a dust precipitator and a gas channel to a reaction vessel wherein the air jetted to said charge space is removed from said charge space through said outlet.

4. A feeding unit according to claim 1 wherein said feeding unit further includes a storage space having an open pipe at the top thereof which projects into the particulate material in the silo and a siphon horizontally disposed below said storage space wherein said nozzle is situated below said open pipe.

5. A feeding unit according to claim 4 wherein said charge space is in the form of a double cone.

6. A feeding pipe according to claim 5 wherein the inclination of the walls of the lower end of the charge space is at an angle of at least 45°.

* * * * *